United States Patent [19]

Kramer

[11] 4,054,766

[45] Oct. 18, 1977

[54] PORTABLE TOOL SWITCH STRUCTURE

[75] Inventor: John J. Kramer, Jackson, Tenn.

[73] Assignee: Rockwell International Corporation, Pittsburgh, Pa.

[21] Appl. No.: 649,206

[22] Filed: Jan. 15, 1976

[51] Int. Cl.[2] ..... H01H 9/06

[52] U.S. Cl. ..... 200/157; 200/159 A; 310/68 A

[58] Field of Search ..... 200/61.85, 157, 159 A, 200/321; 310/68

[56] References Cited

U.S. PATENT DOCUMENTS

| | | | |
|---|---|---|---|
| 2,744,176 | 5/1956 | Kaman | 200/157 X |
| 2,764,705 | 9/1956 | Albertson et al. | 310/68 |
| 3,142,741 | 7/1964 | Bury | 200/157 |
| 3,250,882 | 5/1966 | Campbell et al. | 200/157 |
| 3,588,411 | 6/1971 | Milcoy | 200/157 |
| 3,676,627 | 7/1972 | Happe | 200/159 A |
| 3,873,796 | 3/1975 | Worobec, Jr. | 200/157 |

*Primary Examiner*—Volodymyr Y. Mayewsky

[57] ABSTRACT

An electric switch is disclosed having a pivotal operating member which carries one contact and also includes biasing means to normally bias the switch to the "off" position.

5 Claims, 5 Drawing Figures

PORTABLE TOOL SWITCH STRUCTURE

BACKGROUND OF THE INVENTION

In this disclosure, a low-cost drill utilizing an electrical switch of novel design is described. Prior switches have been complicated, cumbersome and expensive. The most pertinent prior art uncovered by applicant, U.S. Pat. No. 3,676,627, uses a separate spring element which also carries a contactor. The present invention, by contrast, uses an integral portion of the switch as a biasing means, and further utilizes a preformed leg portion of the switch for retaining one of the electrical contacts.

OBJECTS OF THE INVENTION

It is a principal object of this invention to provide a pivotable, finger-operated switch which is economical to manufacture, easy to assemble and dependable in operation.

It is a further object to provide a switch which utilizes standard electrical fittings for contact members.

It is another object of this invention to utilize the inherent resiliency of plastic materials having high dielectric properties in the operation of a power tool.

DESCRIPTION OF THE PREFERRED EMBODIMENT

The switch of the instant application is shown and described as it is installed in a battery-powered drill, but it will be seen that this invention is applicable to many types of tools.

Figure 1:
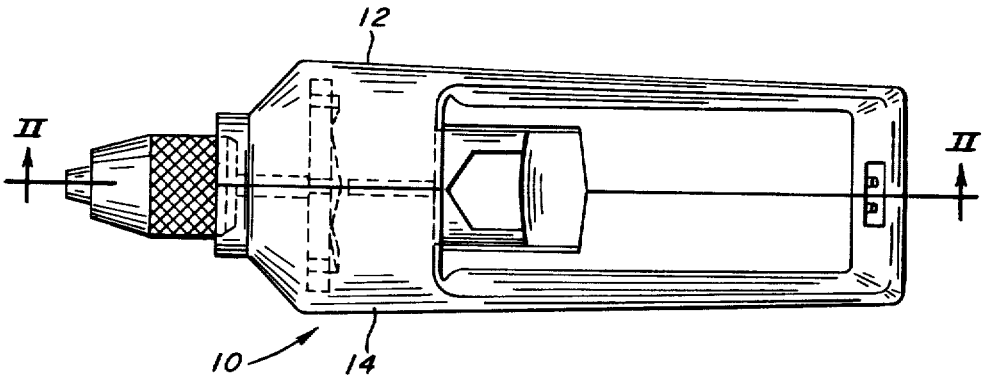
FIG. 1 is a top view of a drill incorporating the present invention.
Figure 2:
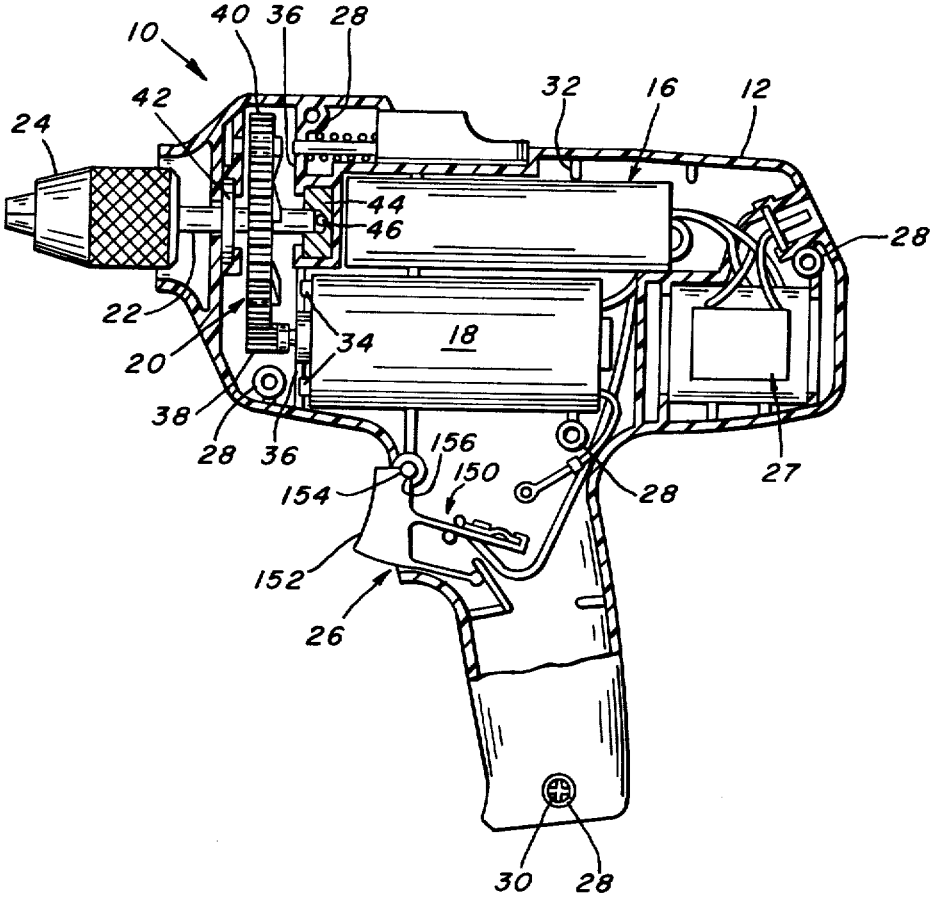
FIG. 2 is a section along the line II—II of FIG. 1.

Referring now to FIGS. 1 and 2, 10 is a cordless electric drill. These hand-held tools have become very popular recently, and usually consist of housing halves 12 and 14, the division being longitudinal. Upon assembly, the necessary components are usually assembled in one half (in this case, 12) and the other half 14 is then screwed to the first half to retain the parts in assembled condition.

The drill 10 contains a number of batteries 16, an electric motor 18 and output gear assembly 20 connecting motor 18 to an output spindle 22. Spindle 22 carries chuck 24 for holding a drill or other tool bit (not shown). Drill 10 also carries a switch assembly 26 and, in this embodiment, a converter unit 27 for recharging batteries 16.

The housing halves 12 and 14 are preferably molded of a plastic with high di-electric properties and high impact strength. The halves have partition walls to retain the elements of the assembly in proper position and bosses 28 for receiving threaded fasteners 30 for retaining the housing halves together. The batteries 16 and motor 18 are cradled in internal walls 32 formed in halves 12 and 14, and after the halves are fastenend together, are trapped between them. Motor 18 has projections 34 for engaging recesses in partition 36 to prevent rotation of the motor.

The armature of motor 18 has a drive pinion 38 mounted on the one end, externally of the motor housing. This pinion meshes with a driven gear 40 which is fixed on output spindle 22. Spindle 22 is journalled in the housing by bearings 42 and 44, the latter also incorporating thrust bearing means 46 in the bearing. Chuck 24 is fixed on the exterior end of the spindle.

The operation of the tool is controlled by trigger switch 150 which is designed to be actuated by the finger of an operator (not shown). This trigger is molded of a stiffly resilient material and has a finger-engaged pivotal portion 152 depending from a cylindrical pivot 154 which is adapted to be received in matching recesses 156 which are molded in the body shells 12 and 14. Internal of the tool handle, a pair of legs 158 and 160 project rearwardly in a generally parallel configuration, when the switch is in the rest or "off" position. In this position, leg 158 rests against a stop member 162 which is molded into housing half 12. This stop member limits the clockwise movement of switch 150 about pivot 154.

Figure 3:
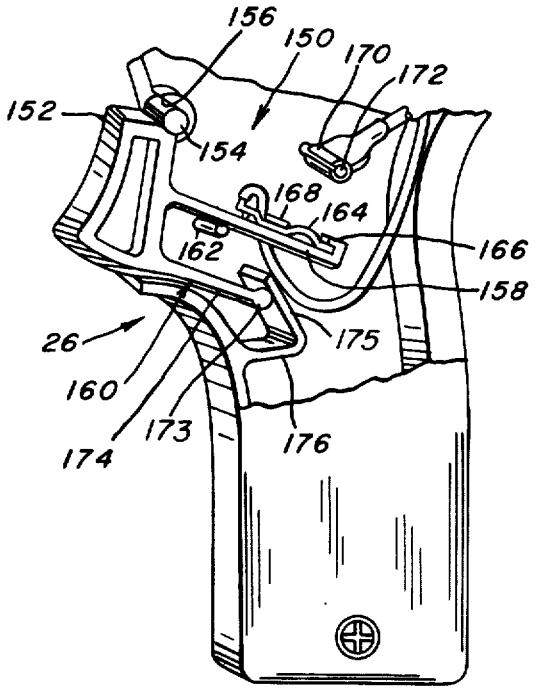
FIG. 3 is an enlarged view of the handle of the drill of FIG. 2, partly broken away to show the switch of the present invention in the "off" position.
Figure 4:
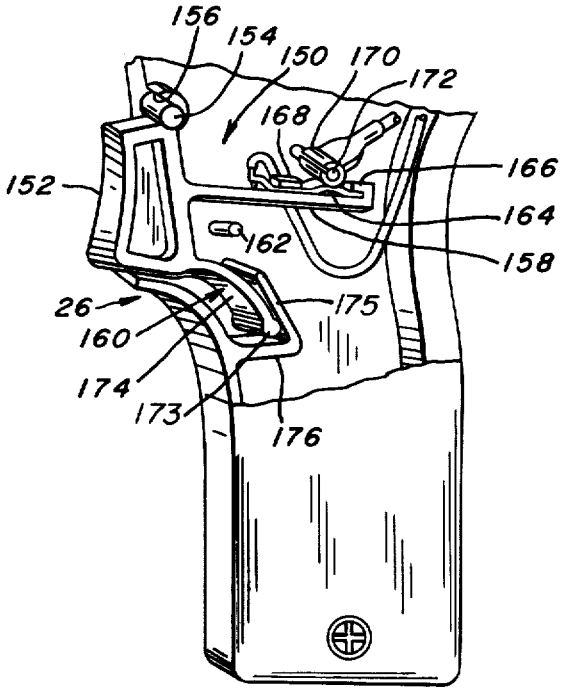
FIG. 4 is a view similar to FIG. 3, but with the switch in the "on" position.
Figure 5:
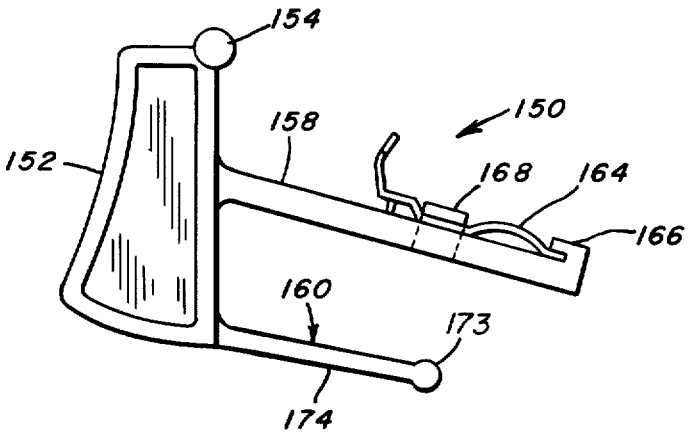
FIG. 5 is an enlarged view of the pivotal operating member with the electrical contact in place.

Referring to FIGS. 3, 4 and 5, leg 158 is also formed with retainers for holding electrical contact 164 which is fixed to an end of the electrical wire supplying power to motor 18 from battery assembly 16. These retainers are molded integrally with the remainder of switch 150, and are designed to provide a snug fit around contact 164. Retainer 166 is formed on the end of leg 158 remote from the base of the leg, and with leg 158 forms a recess into which the end of contact 164 can be slipped from either side or inserted longitudinally. Retainer 168 overlies by 158 a distance away from retainer 166 determined by the size of electrical contact 164. Retainer 168 is open on one side for sliding contact 164 into position. When fixed in assembled position, contact 164 is as shown in FIGS. 3, 4 and 5, being bowed in the center to make better contact when engaged as shown in FIG. 4.

When finger pressure on trigger 150 pivots it, contact 164 engages a contact 170 fixed about a post 172 of housing shell 12. Contact 170 is electrically connected to a wire in the circuit to motor 18. In this manner, operation of the tool is controlled by the workman.

To effect return of the switch to the "rest" position, that shown in FIG. 3, upon release of the trigger by the operator, a biasing leg 160 is provided. Leg 160 has an enlarged end portion 173 which engages a wall 175 in the housing of the drill. As trigger 150 is pivoted inwardly, stem 174 flexes and enlarged end 173 rides downwardly along wall 175. The flexed stem 174 thus provides a biasing force to return trigger assembly 150 outwardly upon release of the finger pressure, restoring the switch to the position shown in FIG. 3, separating contacts 164 and 170.

The base 176 of wall 175 provides rigidity to wall 175 by connecting it with a housing wall portion, but it can also be used as a limit stop for leg 160 limiting the counterclockwise movement of switch 150.

It can be seen that this switch assembly, while shown and described here as being utilized in a battery-powered drill, is applicable to many tools, and is an economical, compact, dependable means of controlling power flow to a motor from a source of power.

What is claimed is:

1. In a manually-manipulable, portable electric power tool, the combination comprising:

a. a handle having an aperture formed therein;

b. an electric switch housed completely within said handle, protected from external exposure, and having "on " and "off" positions; and c. a trigger member mounted within said handle, said trigger member being molded from a plastic material having high di-electric properties and a degree of inherent resiliency, and comprising:

1. pivoting means for mounting in recesses in said handle of said power tool;
2. a finger-engaging portion protruding through said aperture;
3. a leg portion with retaining means for mounting one contact of said electric switch;
4. a second leg portion adapted to engage wall members of said handle;

d. whereby inward depression of said finger-engaging portion produces pivotal movement of said trigger in said handle and thereby moves said one contact into engagement with another electrical contact fixedly mounted in said handle; and e. whereby, during said inward depression, said second leg portion engages said wall member and flexes, due to the resiliency of the plastic material;

f. thereby providing a biasing force to move said actuator member to its initial position upon release of finger pressure, causing separation of said electrical contacts and interrupting power to the tool.

2. The combination of claim 1, wherein stop means is integrally molded in said handle to limit the pivotal movement of said actuator in the "off" position.

3. An electrical switch assembly for a power tool, comprising a trigger member formed from an electrically non-conductive material and adapted to be pivotally mounted in the housing of a tool for movement between a first and second position, the trigger member having a finger engaging portion adapted to project outwardly through an opening in the housing and an integral leg adapted to project inwardly, and having a first electrical contact mounted thereon whereby the contact will move in an arcuate pathway when the trigger member is pivoted between the first and second positions, a second electrical contact mounted in a fixed location within the housing in the path of the movement of the first contact such that pivotal movement of the trigger member to the second position operates to place the contacts in engagement to complete an electrical circuit.

4. The switch assembly of claim 3 further including biasing means normally biasing the trigger member to the first position, and the biasing means including an integral, flexible portion of the trigger member.

5. The switch assembly of claim 4, wherein the flexible portion is adapted to move inwardly as the trigger member is pivoted from its first to its second position, and further including means within the housing for guiding the flexible portion and causing it to flex as it moves inwardly.

* * * * *